US005359989A

United States Patent [19]

Chase et al.

[11] Patent Number: 5,359,989

[45] Date of Patent: Nov. 1, 1994

[54] FURNACE WITH HEAT EXCHANGER

[75] Inventors: Thomas Chase, Derby; Alan Zimmerman, Wichita, both of Kans.

[73] Assignee: Evcon Industries, Inc., Wichita, Kans.

[21] Appl. No.: 26,537

[22] Filed: Mar. 4, 1993

[51] Int. Cl.[5] ..... F24H 3/00

[52] U.S. Cl. ..... 126/110 R; 126/99 R; 126/116 R; 165/170; 165/174

[58] Field of Search ..... 126/110 R, 99 R, 116 R, 126/92 R, 109, 99 A; 165/170, 174, 147, 81

[56] References Cited

U.S. PATENT DOCUMENTS

| | | | |
|---|---|---|---|
| 2,247,849 | 7/1941 | Ritter | 126/116 |
| 2,504,315 | 4/1950 | Feuerfile | 126/110 |
| 2,626,130 | 1/1953 | Raskin | 257/256 |
| 3,058,457 | 10/1962 | Fiedler | 126/91 |
| 3,073,296 | 1/1963 | Hollingsworth et al. | 126/110 |
| 3,140,706 | 7/1964 | Block et al. | 126/110 |
| 3,294,082 | 12/1966 | Norris | 126/116 |
| 3,661,140 | 5/1972 | Raleigh | 126/110 R |
| 3,926,173 | 12/1975 | Jury | 126/110 R |
| 4,467,780 | 8/1984 | Ripka | 126/116 R |
| 4,729,207 | 3/1988 | Dempsey et al. | 126/112 |
| 4,848,314 | 7/1989 | Bentley | 126/116 R |
| 4,982,785 | 1/1991 | Tomlinson | 165/170 |
| 5,060,722 | 10/1991 | Zdenek et al. | 165/170 |
| 5,165,386 | 11/1992 | Van Der Veen | 126/109 |

FOREIGN PATENT DOCUMENTS

| | | | |
|---|---|---|---|
| 158168 | 6/1992 | Japan | 126/109 |

*Primary Examiner*—James C. Yeung
*Attorney, Agent, or Firm*—Tilton, Fallon, Lungmus & Chestnut

[57] ABSTRACT

A furnace includes at least one heat exchanger with first and second plate members secured together to define passageways that form serpentine flow paths between an inlet passageway and an outlet passageway. The inlet passageway receives hot products of combustion from a burner which extends into it. A blower induces the flow of the combustion products through the heat exchanger. A second blower induces the flow of air over the surfaces of the exchanger.

18 Claims, 3 Drawing Sheets

FURNACE WITH HEAT EXCHANGER

BACKGROUND OF THE INVENTION

The present invention relates to a gas furnace, and more particularly to a gas furnace with a heat exchanger that forms serpentine combustion gas flow paths.

Some gas furnaces include a plurality of heat exchangers spaced apart to allow airflow between them. A pair of plates, disposed in face-to-face relation and secured together, form each heat exchanger. The plates define flow paths for hot combustion gases provided by the furnace burners. Heat transfers through the plate portions which define the flow paths to the air flowing around the heat exchangers. The heated air then flows to the area requiring heating.

Such gas furnaces should meet the following requirements:

a. The temperature of combustion gases that discharge from the exchanger must be sufficiently high to avoid the formation of condensation in the heat exchanger during operation;

b. The temperature shear or temperature differential in the heat exchanger must be gradual and consistent from the exchanger's combustion zone to its exhaust zone; thus, minimizing thermal stress in the walls of the heat exchanger;

c. Hot combustion gases must not stratify, and they must accelerate as they move through the exchanger to enhance internal gas-to-surface heat transfer;

d. The passageways defining the flow paths for the combustion gases in the heat exchanger must maintain a constant dynamic pressure distribution for the gases;

e. The exterior surface to air turbulence for the heat exchanger must be sufficiently high to maximize heat transfer per vertical inch of height;

f. The furnace must have a compact construction that minimizes the expense of manufacture, assembly and transport.

The prior art includes a wide variety of the gas furnaces described above; however, because of various inherent design characteristics, the prior furnaces do not fulfill the above-noted criteria. For example, the prior art includes heat exchangers made from formed tubing. Those heat exchangers tend to be efficient and compact, but they are expensive to manufacture and require sophisticated tube forming and joining equipment. The prior art also includes serpentine clamshell heat exchangers, which are less expensive and easier to manufacture than the tube heat exchangers, but tend to be less efficient and larger in size. In contrast, the furnace of the present invention meets the above criteria and provides a compact construction that maximizes heat transfer. It provides the low cost and ease of manufacture of the clamshell heat exchangers and the high efficiency and compact size of the tube heat exchangers.

SUMMARY OF THE INVENTION

In accordance with one embodiment of the present invention, a gas furnace includes a housing, one or more heat exchangers disposed in the housing, burner means for providing hot products of combustion to the heat exchanger, an inducing draft blower for inducing flow through the heat exchanger, and a circulating air blower for circulating air around the heat exchanger.

The heat exchanger includes first and second plate members secured together in face-to-face relation to define an inlet passageway for receiving the burner means and the products of combustion. The plate members also define a plurality of sets of connecting passageways, a plurality of manifold passageways for joining one set of connecting passageways with another set of connecting passageways, and an outlet passageway.

The heat exchanger forms serpentine flow paths for the products of combustion from the inlet passageway, through the connecting passageways, to the outlet passageway. The inlet passageway has a J-like configuration with an elongate main portion having a circular configuration in cross-section and a leg portion with a cross-sectional configuration that varies from circular to flat (with rounded ends).

The connecting passageways have a generally circular configuration in cross-section and a generally constant diameter along their lengths. The diameter of the main portion of the inlet passageway is greater than the diameter of any of the connecting passageways. The diameter of the connecting passageways decreases from one set to the next set with the set disposed after the inlet passageway having the largest diameter of all the connecting passageways.

BRIEF DESCRIPTION OF THE DRAWINGS

For a more complete understanding of this invention one should now refer to the embodiment illustrated in greater detail in the accompanying drawings and described below by way of an example of the invention. In the drawings.

While the following disclosure describes the invention in connection with one embodiment one should understand that the invention is not limited to this embodiment. Furthermore, one should understand that the drawings are not to scale and that graphic symbols, diagrammatic representations, and fragmentary views, in part, illustrate the embodiment. In certain instances, the disclosure may not include details which are not necessary for an understanding of the present invention such as conventional details of fabrication and assembly.

DETAILED DESCRIPTION OF THE DRAWINGS AND AN EMBODIMENT

Figure 1:
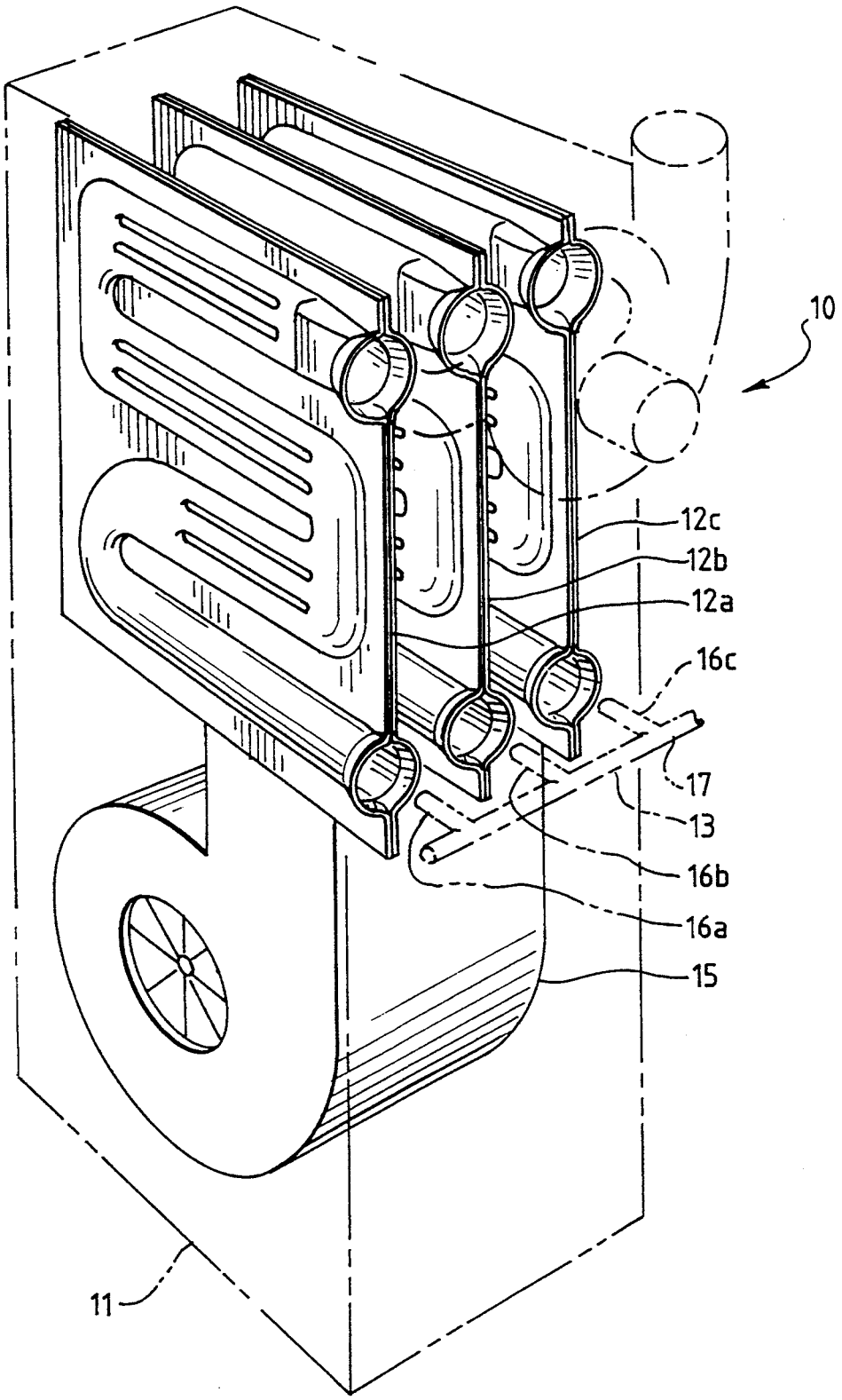
FIG. 1 is a perspective view of the furnace of the present invention with the housing, burner assembly and inducing blower shown in phantom lines.
Figure 2:
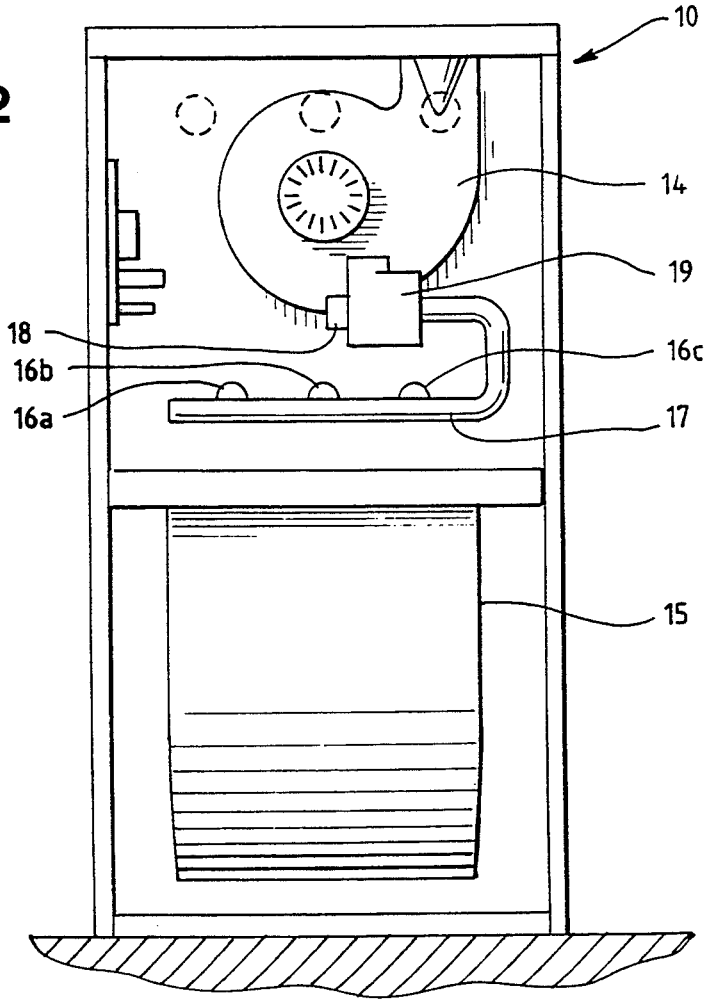
FIG. 2 is a front elevation view of the furnace of the present invention.
Figure 3:
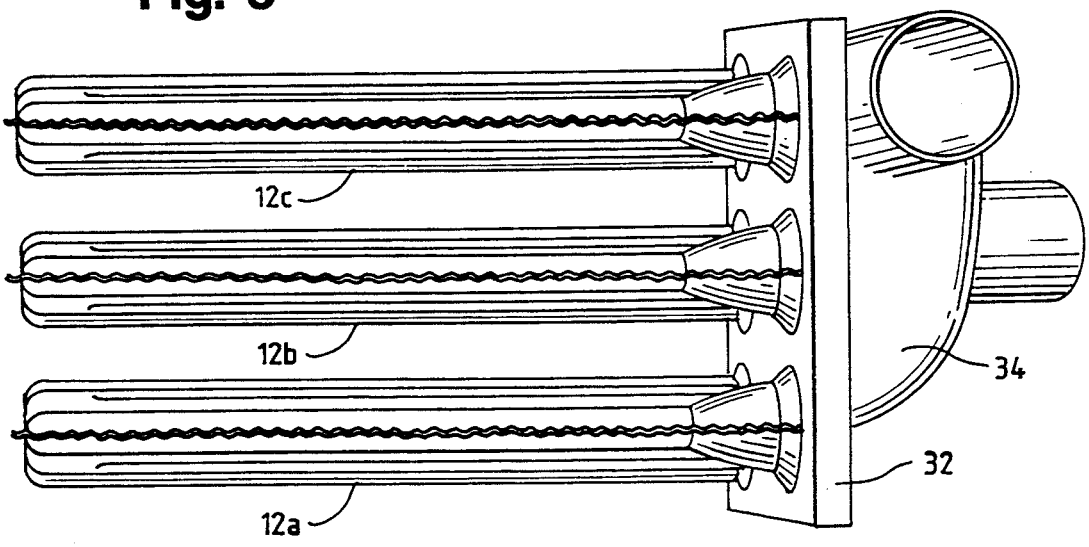
FIG. 3 is a top plan view of the heat exchangers used in the furnace shown in FIGS. 1.
Figure 4:
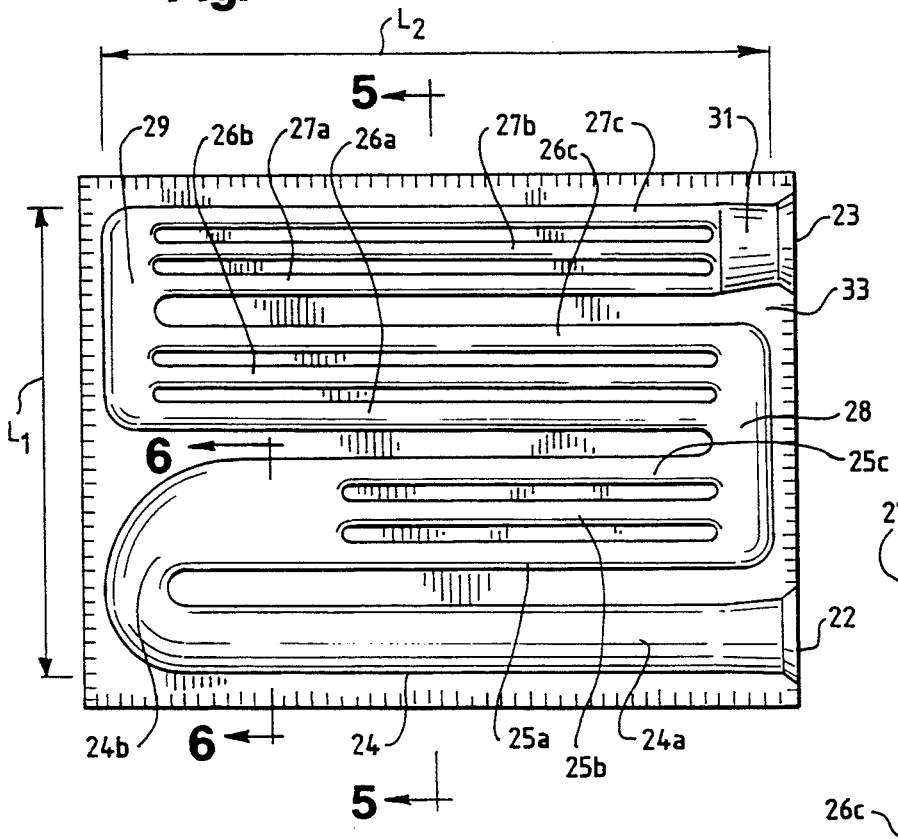
FIG. 4 is a side elevation view of the heat exchanger used in the furnace of the present invention.
Figure 6:
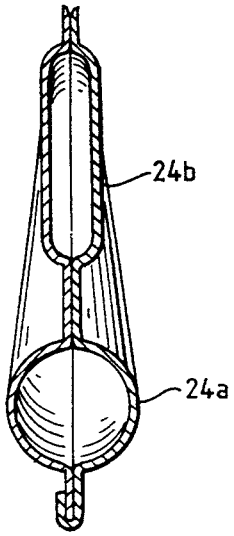
FIG. 6 is a sectional view taken along line 6—6 in FIG. 4.

Referring now to the drawings and more particularly to FIGS. 1 and 2, one form of the improved gas furnace 10 generally includes a housing 11, three heat exchangers 12*a*, 12*b* and 12*c*, and a burner assembly 13 for providing hot products of combustion to the heat exchangers. It also includes an induced draft blower 14 for inducing the flow of combustion products through the heat exchangers, and a circulating air blower 15 for circulating air around the heat exchangers. The heat exchangers 12*a–c* lie in a compact arrangement, upright and spaced a predetermined distance apart. The circulating air blower 15 lies below the heat exchangers; and it forces ambient air in an upwardly direction, past the heat exchangers and through an outlet at the top of the furnace housing.

The burner assembly 13 includes three inshot burners 16*a–c* for the heat exchangers 12*a–c*, respectively. The burners receive gas from a gas supply (not shown) through a conduit 17. A gas pipe inlet 18 directs the supply of gas through a valve 19. Each burner extends to the corresponding heat exchanger and directs its products of combustion into the exchanger, as described below.

Each one of the heat exchangers 12*a–c* includes a first plate member 20 and a second plate member 21 secured together in face-to-face relation (See FIGS. 3–6). The plate members 20 and 21 have surfaces stamped or otherwise formed into mirror images of each other. They have a generally rectangular peripheral configuration with the member 20 having a length and width greater than the length and width of the member 21. This difference in size allows folding and crimping of the edge portions of the member 20 over the edge portions of the member 21 to secure the members together around their peripheries (except at the inlet 22 and the outlet 23 of the heat exchangers).

The plate members 20 and 21 of each heat exchanger define passageways which form serpentine flow paths through which the hot products of combustion travel. They define an inlet passageway 24 which receives a flame through the opening 22 and the combustion products the burner provides. The inlet passageway has a J-like configuration with an elongate main portion 24*a* having a generally circular configuration in cross-section and a leg portion 24*b* with a cross-sectional configuration that varies from circular to flat (with rounded ends, See FIG. 6). One end of the leg portion 24*b* curves around towards the inlet 22 and the other end is a transition from one tube or passageway into the three connecting tubes described below.

The plates 20 and 21 also define three sets of three connecting tubes 25*a–c*, 26*a–c*, and 27*a–c*; two manifold passageways 28 and 29; and an outlet passageway 31. The manifold passageway 28 connects the first set of connecting passageways 25*a–c* with the second set of connecting passageways 26*a–c*; and the manifold 29 connects the second set of connecting passageways with the third set of connecting passageways 27*a–c*.

The walls of the passageways 24, 25*a–c*, 26*a–c*, 27*a–c* and 31 extend across the flow of circulating air perpendicularly of the direction of flow, increasing the surface turbulence of the air moving over the surface of the heat exchanger and improving heat transfer. The main portion of the inlet passageway 24 extends across the heat exchanger along one edge of the heat exchanger. The connecting passageways 25*a–c*, 26*a–c*, and 27*a–c* extend across the exchanger parallel to the main portion of inlet passageway 24. Each set of connecting passageways lies a predetermined distance from an adjacent set or from the main portion of the inlet passageway 24. Each passageway within each set lies a predetermined distance from an adjacent passageway in the set. The manifold passageways 28 and 29 extend perpendicularly to the connecting passageways.

Figure 5:
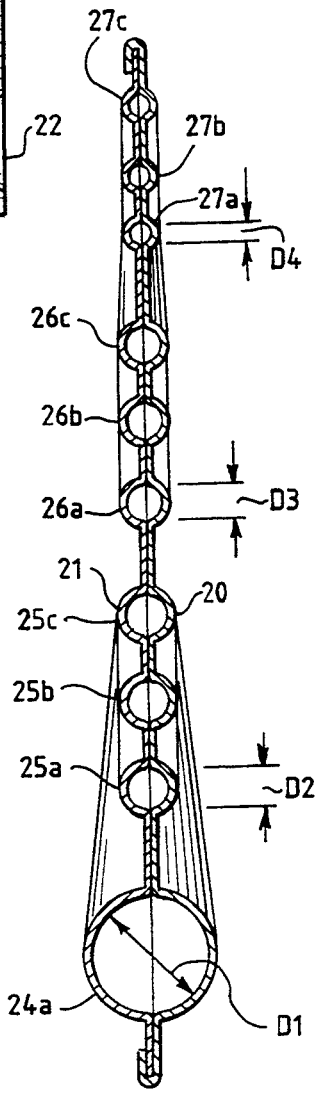
FIG. 5 is a sectional view taken along line 5—5 in FIG. 4.

The main portion of the inlet passageway and the connecting passageways have a circular configuration (in cross-section); and the diameter of the passageways in one set differ from that of another set and from the diameter of the main portion of the inlet passageway. As shown in FIG. 5, the main portion of the inlet passageway has an inside diameter D1; the first set of connecting tubes have an inside diameter of D2; the second set of connecting tubes have an inside diameter D3; and the third set of connecting tubes have an inside diameter D4. The diameter D1 is greater than the diameter D2; D2 is greater than D3; and D3 is greater than D4. The cross-sectional area of the inlet passageway at any point along its length is greater than the cross-sectional area of any of the connecting passageways.

The passageways described above provide efficient heat transfer through the walls of the plate members. The gradual decrease in diameters allow the combustion products or gases to accelerate through the heat exchanger, enhancing internal gas-to-surface heat transfer. The circular cross-section of the connecting passageways also provides strength and integrity to the exchanger structure and eliminates the need for indents or embossed dimples to prevent collapse from thermal expansion.

As stated above, the heat exchangers 12*a–c* lie upright and spaced apart to allow air flow around each one of them. An outlet manifold 32 welded or otherwise secured to an edge portion 33 of each heat exchangers receives the combustion products from the outlet passageway 31. This outlet manifold 32 lies in the circulating airstream within the furnace 10 to further enhance heating capacity. An inducing blower 34 draws the combustion products from the outlet manifold to a flue duct (not shown). The inducing blower 34 induces flow through the heat exchangers 12*a–c*, moving the combustion products from the inlet passageways 24, through the manifold, connecting and outlet passageways, into the outlet manifold 32, and through the flue duct. It lies below the center line of the outlet manifold (and below the outlet passageways) to impede the migration of flue gases during the off-cycle of the burners.

The embodiment described above includes three heat exchangers; and each heat exchanger includes three sets of connecting passageways. Alternatively, the furnace 10 may include more than the three heat exchangers shown; and it may include less than three. In addition, the heat exchangers may include more than three sets or less than three sets of connecting passageways. Although each set of connecting passageways includes three passageways, it may include more than three or less than three passageways.

As a specific example, a gas furnace with a compact construction that maximizes heat transfer was fabricated with a heat exchanger having an inside diameter D1 of $1\frac{3}{4}$ inches, an inside diameter D2 of $\frac{7}{8}$ inch, an inside diameter D3 of $\frac{3}{4}$ inch, and an inside diameter D4 of $\frac{5}{8}$ inch. This heat exchanger has a length $L_1$ of $12\frac{5}{8}$ inches, a length $L_2$ of $18\frac{1}{2}$ inches and a length of $15\frac{3}{4}$ inches for tubes 26*a–c* and 27*a–c*.

While the above description and the drawings disclose and illustrate one embodiment, one should understand, of course, that the invention is not limited to this embodiment. Those skilled in the art to which the invention pertains may make modifications and other embodiments employing the principles of this invention, particularly upon considering the foregoing teachings. Therefore, by the appended claims, the applicant intends to cover any modifications and other embodiments as incorporate those features which constitute the essential features of this invention.

What is claimed is:

1. In a furnace having burner means for providing hot products of combustion, a heat exchanger for transferring heat from the products of combustion to air moving through the furnace, the heat exchanger comprising: first and second plate members secured together in face-to-face relation to define an inlet passageway for receiving the products of combustion, a plurality of sets of connecting passageways, at least one manifold passageway for joining one set of connecting passageways with another set of connecting passageways, and an outlet passageway, the passageways cooperating to form serial and serpentine flow paths for the products of combustion from the inlet passageway, through the connecting passageways, to the outlet passageway, the cross sectional area of the inlet passageway at any point along its length being greater than the cross-sectional area of any of the connecting passageways, the cross-sectional area of each set of passageways decreasing from one set to the next from the inlet to the outlet passageways.

2. The furnace of claim 1, wherein each set of connecting passageways has the same number of passageways as the other sets of connecting passageways.

3. The furnace of claim 1, wherein the connecting passageways have a circular cross-sectional configuration.

4. The furnace of claim 3, wherein the passageways of each set of connecting passageways have the same diameter.

5. The furnace of claim 4, wherein the diameter of the connecting passageways decreases from one set to the next set, with the set of connecting passageways disposed after the inlet passageway having the largest diameter of all the connecting passageways.

6. The furnace of claim 1, wherein the passageways of each set of connecting passageways lie in spaced, parallel relation.

7. The furnace of claim 6, wherein the passageways of one set of connecting passageways lie in parallel relation to the passageways of the other sets.

8. The furnace of claim 7, wherein the manifold passageway lies generally perpendicularly to the connecting passageways.

9. The furnace of claim 1, wherein the plate members have a generally rectangular peripheral configuration and are disposed in overlapping relation with edge portions of one plate folded over the edge portions of the other to secure the plate members together and form a generally rectangular heat exchanger.

10. The furnace of claim 9, wherein the inlet passageway has a generally J-like configuration with a main portion and a leg portion, and wherein the leg portion lies along one edge portion of the heat exchanger, the connecting passageways lie in parallel relation to the main portion of the inlet passageway, and the manifold passageway lies in perpendicular relation to the connecting passageways.

11. In a furnace having burner means for providing hot products of combustion, a heat exchanger for transferring heat from the products of combustion to air moving through the furnace, the heat exchanger comprising: first and second plate members secured together in face-to-face relation to define an inlet passageway for receiving the products of combustion, a plurality of sets of connecting passageways, at least one manifold passageway for joining one set of connecting passageways with another set of connecting passageways, and an outlet passageway, the passageways cooperating to form serial, serpentine flow paths for the products of combustion from the inlet passageway, through the connecting passageways, to the outlet passageway, the connecting passageways having a generally circular cross-sectional configuration and a generally constant diameter along their lengths, the inlet passageway having a generally J-like configuration with a main portion and a leg portion, the main portion having a generally circular cross-sectional configuration, the diameter of the main portion of the inlet passageway being greater than the diameter of any of the connecting passageways, and the diameter of the connecting passageways decreasing from one set to the next set with the set of passageways disposed after the inlet passageway having the largest diameter of all the connecting passageways, the main portion of the inlet passageway having a diameter substantially larger than the diameter of any of the connecting passageways.

12. The furnace of claim 11, wherein the main portion of the inlet passageway, the connecting passageways, and the outlet passageway lie in substantially parallel relation.

13. The furnace of claim 11, wherein the heat exchanger includes three sets of connecting tubes with three connecting tubes in each set.

14. A furnace comprising: a housing; burner means disposed in the housing for providing hot products of combustion; at least one heat exchanger disposed in the housing for transferring heat from the products of combustion to air moving through the housing, the heat exchanger including first and second plate members secured together in face-to-face relation to define an inlet passageway for receiving the burner means and the hot products of combustion which the burner means provide, a plurality of sets of connecting passageways, at least one manifold passageway for joining one set of connecting passageways with another set of connecting passageways, and an outlet passageway, the passageways cooperating to form serial, serpentine flow paths for the products of combustion from the inlet passageway, through the connecting passageways, to the outlet passageway, the cross-sectional area of the inlet passageway at any point along its length being greater than the cross-sectional area of any of the connecting passageways at any point along their length, the cross-sectional area of each set of passageways decreasing from one set to the next from the inlet to the outlet passageways; air inducing blower means connected to the heat exchanger for inducing the flow of the products of combustion through the heat exchanger; a circulating blower means disposed in the housing for inducing the flow of air over the surface of the heat exchanger.

15. The furnace of claim 14, wherein the connecting passageways have a generally circular configuration and a generally constant diameter along their lengths, the diameter of the connecting passageways decreasing from one set to the next set with the set of passageways disposed after the inlet passageway having the largest diameter.

16. The furnace of claim 15, further comprising one or more additional heat exchangers and an outlet manifold disposed in fluid communication with the outlet passageway of each heat exchanger and with the first blower means.

17. The furnace of claim 16, wherein the heat exchangers are disposed upright, in spaced relation.

18. In a furnace having burner means for providing hot products of combustion, a heat exchanger for transferring heat from the products of combustion to air moving through the furnace, the heat exchanger comprising: first and second plate members secured together in face-to-face relation to define an inlet passageway for receiving the products of combustion, a plurality of sets of connecting passageways, at least one manifold passageway for joining one set of connecting passageways with another set of connecting passageways, and an outlet passageway, the passageways cooperating to form serial and serpentine flow paths for the products of combustion from the inlet passageway, through the connecting passageways, to the outlet passageway, the cross sectional area of the inlet passageway at any point along its length being greater than the cross-sectional area of any of the connecting passageways, the cross-sectional area of each set of passageways decreasing from one set to the next from the inlet to the outlet passageways; said connecting passageways having a circular cross-sectional configuration.

* * * * *